US007431530B1

(12) United States Patent
Powers

(10) Patent No.: US 7,431,530 B1
(45) Date of Patent: Oct. 7, 2008

(54) TOOTHBRUSH METHODS AND APPARATUS

(76) Inventor: Ned Powers, 19565 Sunshine Way, Bend, OR (US) 97702

( * ) Notice: Subject to any disclaimer, the term of this patent is extended or adjusted under 35 U.S.C. 154(b) by 469 days.

(21) Appl. No.: 11/104,073

(22) Filed: Apr. 12, 2005

Related U.S. Application Data

(60) Provisional application No. 60/562,036, filed on Apr. 13, 2004.

(51) Int. Cl.
*A46B 11/04* (2006.01)

(52) U.S. Cl. ..... 401/291; 401/289; 401/132; 401/284

(58) Field of Classification Search ..... 401/291, 401/289, 132–135, 284; 15/167.1
See application file for complete search history.

(56) References Cited

U.S. PATENT DOCUMENTS 1,797,946 A * 3/1931 Eichel ..... 401/184
1,947,720 A * 2/1934 Laub ..... 401/7
1,947,721 A * 2/1934 Laub ..... 401/152
2,090,144 A * 8/1937 Palimeri et al. ..... 401/135
2,668,973 A 2/1954 Glaza
2,932,044 A * 4/1960 Woodrow ..... 401/201
2,946,072 A 7/1960 Filler et al.
3,271,805 A 9/1966 Sawyer
3,536,410 A * 10/1970 Wargoe ..... 401/132
3,879,139 A * 4/1975 Dahl et al. ..... 401/135
4,362,174 A 12/1982 Baker
4,683,604 A 8/1987 Rueb
4,890,732 A 1/1990 Shackelford
5,224,234 A * 7/1993 Arsenault et al. ..... 15/167.1
5,366,310 A * 11/1994 Armelles Flors ..... 401/132
5,737,792 A * 4/1998 Quigless ..... 15/167.1
2007/0266512 A1 * 11/2007 Huber et al. ..... 15/167.1

FOREIGN PATENT DOCUMENTS

GB 2044089 A 10/1980

* cited by examiner

*Primary Examiner*—Khoa D Huynh
(74) *Attorney, Agent, or Firm*—Richard S. Erbe

(57) ABSTRACT

A toothbrush includes a handle that is sized and configured for grasping, and a head that is provided with bristles. The head may be removed from the handle and replaced. Toothpaste may be contained in the head and forced into the bristles. The handle and a number of heads may be provided in a kit. Each head is provided in a separate sealed housing that allows the head to be attached to the handle without requiring a person assembling the toothbrush to remove the head from the packaging or touch the head.

16 Claims, 4 Drawing Sheets

FIG. #1
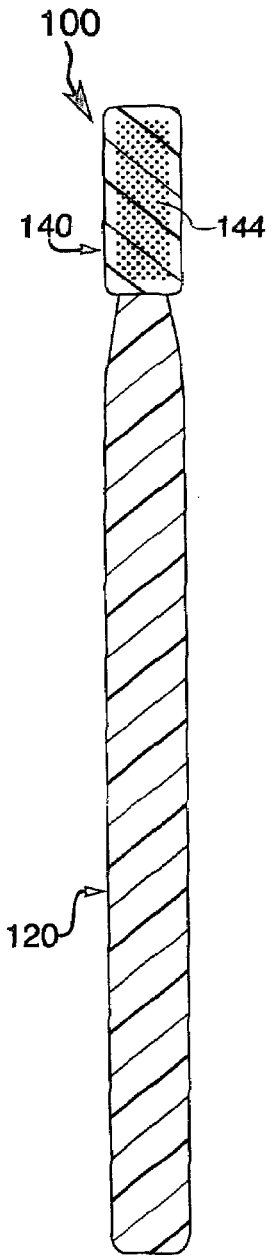
FIG. #2
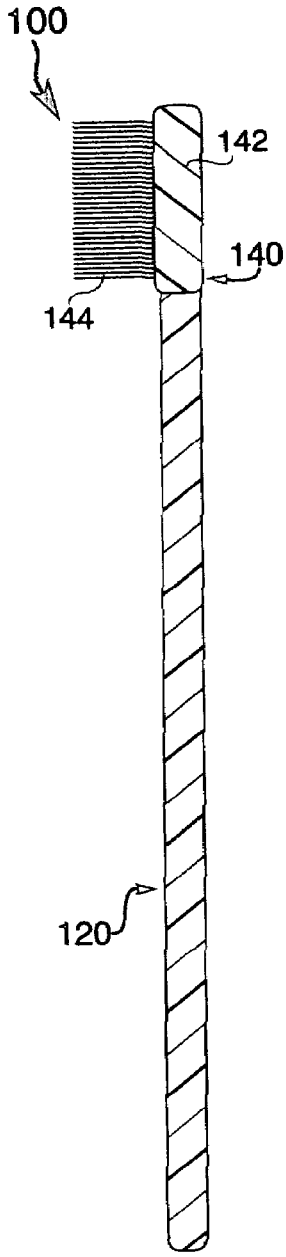
FIG. #3
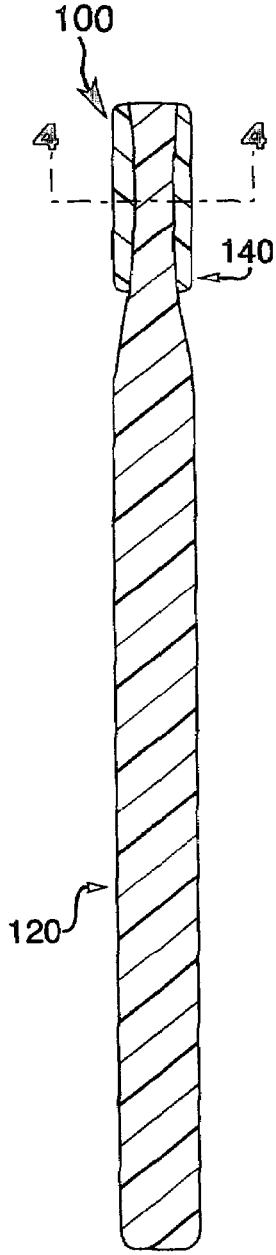

FIG. #4
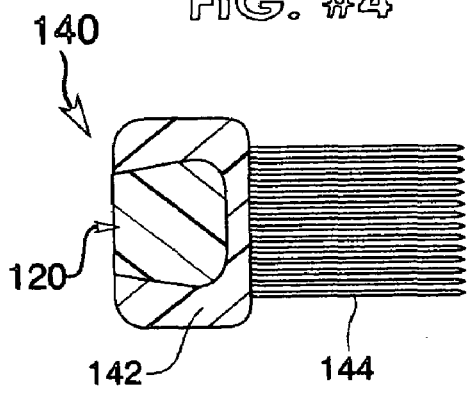
FIG. #5
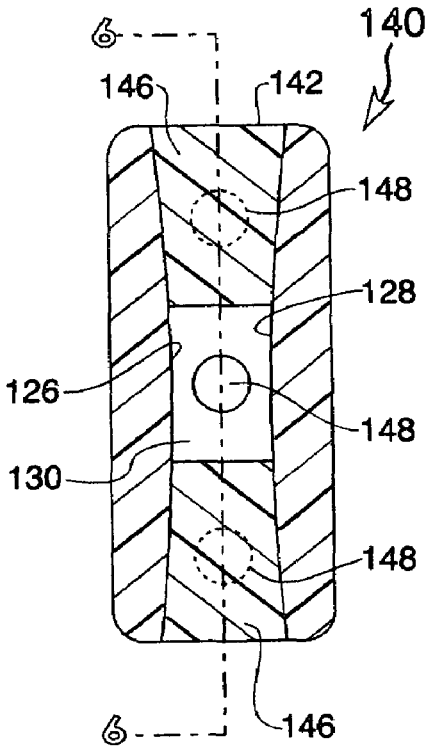
FIG. #6
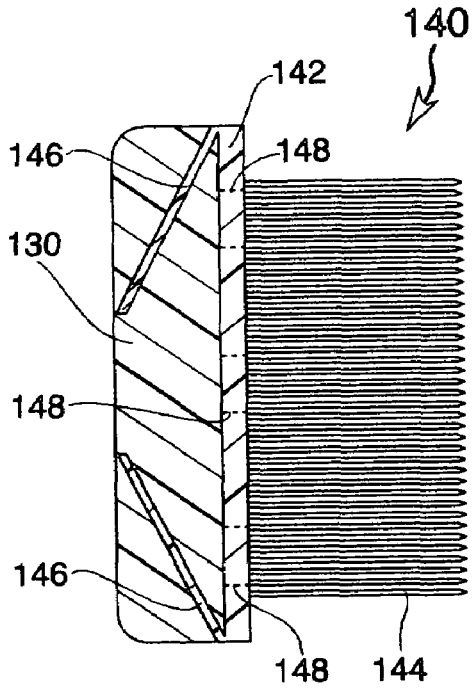

FIG. #7
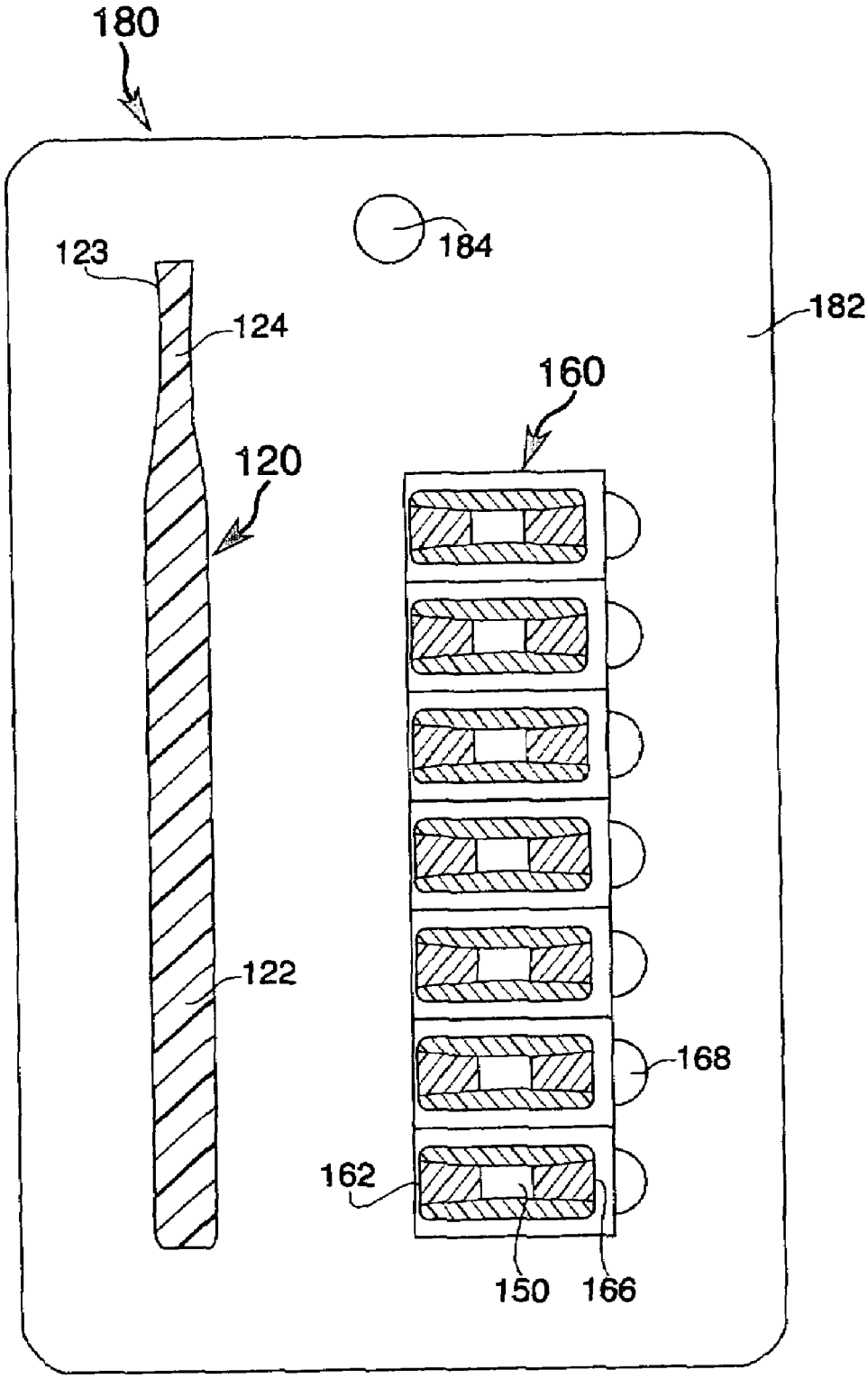

FIG. #8
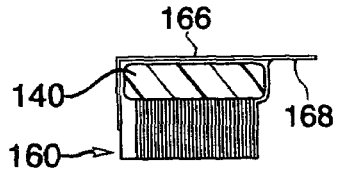
FIG. #8a
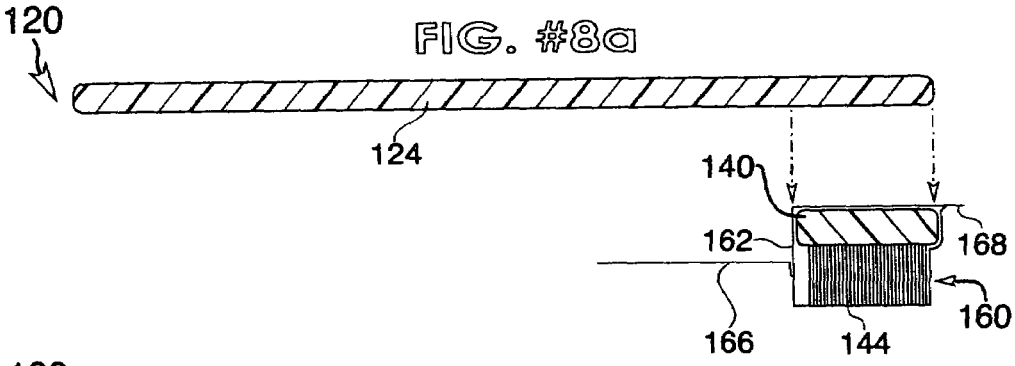
FIG. #8b
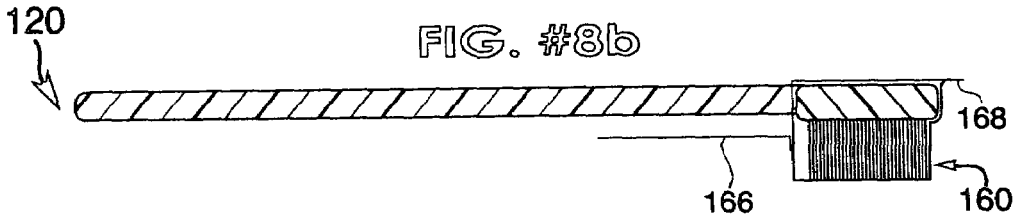
FIG. #8c
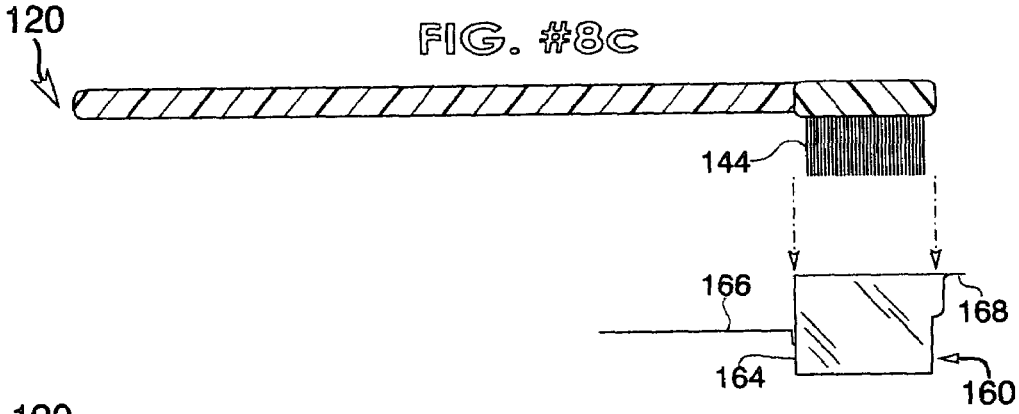
FIG. #8d
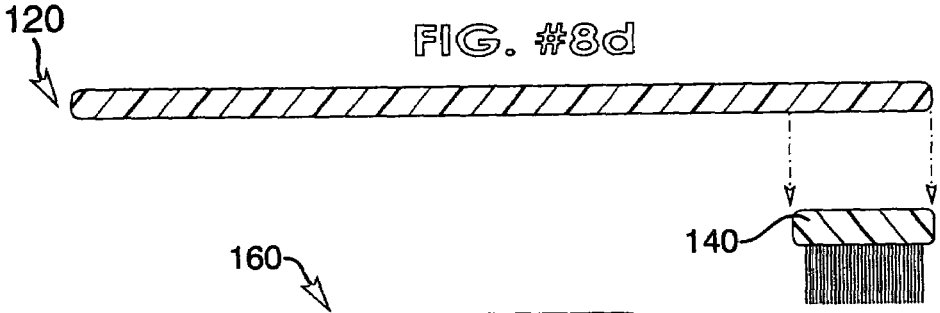
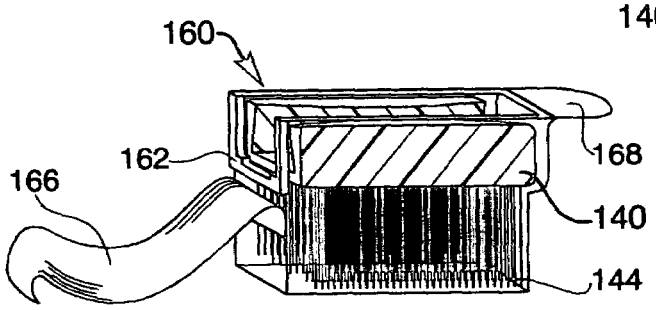
FIG. #8e

TOOTHBRUSH METHODS AND APPARATUS

RELATED APPLICATIONS

This application claims the benefit of U.S. Provisional Application for Patent No. 60/562,036, filed Apr. 13, 2004, incorporated herein by reference.

BACKGROUND OF THE INVENTION

1. Field of the Invention

The present invention relates to toothbrushes, and, more particularly, to a toothbrush having a detachable, disposable head and methods of using such a toothbrush.

2. General Background and State of the Art

Toothbrushes may be found in a variety of sizes and configurations. The most commonly known toothbrush is of a unitary construction, generally having a handle at one end and brushing bristles at the other end. There are known designs of toothbrushes which, although not as well-known, are designed with either retractable or removable brushing heads. Examples of the latter are disclosed in U.S. Pat. No. 246,934 to Arment, et al.; U.S. Pat. No. 1,642,620 to Merrill; U.S. Pat. No. 1,794,711 to Jacobs; U.S. Pat. No. 5,224,234 to Aesenault, et al.; and U.S. Pat. No. 5,980,145 to Griffith.

Although the concept of having a toothbrush with a removable/replaceable brushing head has been known, and despite advances in the art, room for improvement remains with respect to this type of toothbrush. For example, certain designs of toothbrushes having removable/replaceable brushing heads create spaces where material and bacteria can collect and create health risks. Also, none of the known toothbrushes of this type include a provision for securing and delivering toothpaste.

SUMMARY OF THE INVENTION

The present invention, in a broad aspect, provides the user with various toothbrush methods and apparatus. Generally, an apparatus according to the present invention provides a handle with a first end that is sized and configured for grasping, and a second end that is contoured to achieve a snap fit, but without any resulting internal corners, ridges or crevices where bacteria, dirt, germs and the like may collect.

A head is provided with brushing bristles that project outward from a first side of the head, and a channel is formed in a second, opposite side of the head. The channel is configured to receive and retain the second end of the handle by means of a snap fit. The head is detached by grasping the handle near the second end and pushing the head away with the thumb, in a direction generally parallel to the brushing bristles.

Toothpaste may be disposed within the channel and dispensed between the brushing bristles during attachment of the head.

Further objects and advantages of this invention will become more apparent from the following description of the preferred embodiment, which, taken in conjunction with the accompanying drawings, will illustrate, by way of example, the principles of the invention.

BRIEF DESCRIPTION OF THE DRAWINGS

The foregoing and other aspects and advantages of the present invention will be better understood from the following detailed description of the preferred embodiments of the invention with reference to the drawings in which:

FIG. 1 illustrates a plan view of a toothbrush constructed in accordance with an exemplary embodiment of the present invention;

FIG. 2 illustrates a side view of a toothbrush constructed in accordance with an exemplary embodiment of the present invention;

FIG. 3 illustrates a bottom view of a toothbrush constructed in accordance with an exemplary embodiment of the present invention;

FIG. 4 illustrates a sectional view taken along line 4-4 in FIG. 3;

FIG. 5 illustrates a bottom view of a toothbrush constructed in accordance with an exemplary embodiment of the present invention, showing the handle inserted into the brushing head;

FIG. 6 illustrates a sectional view taken along line 6-6 in FIG. 5;

FIG. 7 illustrates a plan view of a package containing a number of heads and a handle of a toothbrush constructed in accordance with an exemplary embodiment of the present invention;

FIG. 8 illustrates a side view of one of the tooth brush heads of a toothbrush constructed in accordance with an exemplary embodiment of the present invention in its own individual sealed housing;

FIG. 8*a* illustrates a side view of the sealed housing illustrated in FIG. 8 unsealed, and the handle illustrated in FIG. 7 aligned with the toothbrush head of a toothbrush constructed in accordance with an exemplary embodiment of the present invention inside of the housing;

FIG. 8*b* illustrates a side view of the housing illustrated in FIG. 7 engaged with the tooth brush head of a toothbrush constructed in accordance with an exemplary embodiment of the present invention;

FIG. 8*c* illustrates a side view of a handle and a toothbrush head removed from the housing illustrated in FIG. 8*a;*

FIG. 8*d* illustrates a side view of a toothbrush head of a toothbrush constructed in accordance with an exemplary embodiment of the present invention removed from the handle; and FIG. 8*e* illustrates a perspective view of one of the tooth brush heads of a toothbrush constructed in accordance with an exemplary embodiment of the present invention in its own individual sealed housing with the sealant material partially peeled away from the housing.

Further objects and advantages of this invention will become more apparent from the following description of the preferred embodiments, which, taken in conjunction with the accompanying drawings, will illustrate, by way of example, the principles of the invention.

DETAILED DESCRIPTION OF THE PREFERRED EMBODIMENTS OF THE INVENTION

In the following description of the invention, reference is made to the accompanying drawings, which form a part thereof, and in which are shown, by way of illustration, exemplary embodiments illustrating the principles of the present invention and how it may be practiced. It is to be understood that other embodiments may be utilized to practice the present invention and structural and functional changes may be made thereto without departing from the scope of the present invention.

FIGS. 1-3 illustrate an embodiment of a toothbrush 100 constructed in accordance with the principles of the present invention. Toothbrush 100 may be described broadly in terms of having a handle 120 and a head 140. As further described below, head 140 is preferably stored inside a sealed housing 160 prior to use.

FIGS. 7 and 8*d* illustrate the handle 120 apart from head 140. Handle 120 may be described in terms of a handle end 122 that is sized and configured to be grasped by a human hand, and an opposite head end 124 that is sized and configured to snap into engagement with head 140. Handle end 122 is shown in its most basic form with the understanding that various contours, grips, surfaces, patterns and/or materials may be used in a manner known in the art to make the handle end 122 ergonomic. Also, various designs, patterns, etc., can be used to provide specific theming for specific locations, events, or characters.

One of the advantages of a toothbrush according to the present invention is that a relatively "high end" handle may be made for relatively longer term use than a conventional toothbrush, because head 140 may be removed and replaced repeatedly without the need to acquire a new handle. In addition, although handle 120 is depicted as a linear member, head end 124 may be arranged at any desired angle relative to handle end 122 without departing from the scope of the present invention.

As illustrated in FIG. 7, head end 124 of handle 120 is bounded by opposite side walls 123 that are outwardly concave. Also, head end 124 has a cross-section or profile that is trapezoidal, as illustrated in FIG. 4. More generally speaking, head end 124 has a profile that is configured to be overlapped by opposing sides of head 140, as further discussed below.

Another advantage with a toothbrush according to the present invention is that head end 124 of handle 120 is configured to have smooth, continuous surfaces that may be readily wiped clean to remove bacteria, dirt, germs, and the like. Another way to describe this configuration is that head end 124 is provided without any internal corners, ridges or crevices where two planar surfaces meet.

FIGS. 5, 6 and 8*d* illustrate head 140 disposed away from handle 120. Head 140 may be described in terms of base 142 and bristles 144 projecting outward from base 142. Bristles 144 are depicted in a most basic form, but those skilled in the art will recognize that various known bristle types and arrangements may be used in connection with the present invention.

As illustrated in FIGS. 5 and 6, base 142 is provided with a longitudinally extending channel 130 that is bounded by opposing side walls 126 and 128 that are inwardly convex. As illustrated in FIG. 4, channel 130 has a cross-section or profile that may be described as trapezoidal and/or configured to fit snugly about head end 124 of handle 120. Base 142 is preferably made of resilient plastic that is sufficiently flexible to accommodate a "snap fit" insertion and removal of head end 124 of handle 120. The complementary curved shapes of sidewalls 126 and 128 cooperate to discourage movement of head 140 in a longitudinal direction along handle 120, and the complementary trapezoidal profiles of head end 124 and channel 130 cooperate to discourage movement of head 140 in a direction generally parallel to bristles 144.

FIG. 8*a* illustrates how handle 120 is fastened onto head 140 by pressing handle 120 towards head 140, while FIG. 8*d* illustrates how handle 120 is moved in relation to bristles 144 to remove head 140 from the handle. In each instance, head 140 may be angled during the steps illustrated in FIGS. 8*a* and 8*d* (within the plane of the drawing sheet) in a manner that initially spreads one or both of walls 126 or 128 apart to receive an aligned portion of handle end 124. When the step illustrated in FIG. 8*b* is completed, side walls 126 and 128 have moved back toward one another and into the position illustrated in FIG. 4. The process illustrated is somewhat analogous to opening and closing a Zip-Loc™ plastic bag.

FIGS. 5 and 6 also illustrate opposing flexible flaps 146 having first ends that are secured to respective ends of base 142, and opposite distal second ends. Flaps 146 cooperate with side walls 126 and 128 to define a central compartment within channel 130, and holes 148 extend through base 142 to place the central compartment in communication with the spaces between bristles 144. As illustrated in FIG. 7, toothpaste 150 is preferably stored within the compartment for automatic dispensing when head 140 is secured onto handle 120. In this regard, head end 124 of handle 120 presses flaps 146 toward holes 148, and flaps 146 encourage toothpaste 150 to pass through holes 148 rather than out the opposite ends of channel 130. In another embodiment of the invention, flaps 146 may be eliminated or replaced by other suitable structure (for example, a thin sheet of plastic that seals toothpaste 150 inside channel 130). In either embodiment, the structure (flaps 146 or the plastic sheet) defines a deformable compartment for toothpaste 150.

FIG. 7 illustrates package 180 that holds handle 120 and multiple heads 140. Package 180 is preferably of the "blister-pack" type construction or other conventional packaging and may be described in terms of a cardboard sheet 182 and a transparent plastic face that is configured to house handle 120 and heads 140, and to adhere to available portions of sheet 182. A hole 184 may be provided through an upper portion of sheet 182 to facilitate hanging and display of package 180 on a hook.

Each of the heads 140 is provided inside its own sealed housing 160. Each such housing preferably includes a blister-pack type shell 164 that is sized and configured to accommodate head 140, and a strip 166 of sealant material that adheres to the perimeter of shell 164 in a manner known in the art to form a seal that protects head 140 and toothpaste 150. A tab 168 projects outward from an edge of shell 164 to facilitate grasping of strip 166 for purposes of opening housing 160. Also, as illustrated in FIGS. 7 and 8*e*, notch 162 is provided in shell 164 to align with channel 130 in head 140 and accommodate head end 124 of handle 120 as illustrated in FIG. 8*b*.

The present invention may be described in terms of toothbrush 100, its associated packaging 160 and/or 180, and/or various involving the same. For example, the present invention may be described in terms of a method of brushing teeth. The method includes the steps of providing a handle 120 having a handle end 122 that is sized and configured for grasping, and a head end 124; providing a head 140 having a base 142 that is sized and configured to snap onto head end 124 of handle 120, and bristles 144 that project outward from a first side of base 142; aligning head end 124 with a channel 130 in an opposite, second side of base 142; and moving head end 124 parallel to bristles 144 to snap head end 124 into channel 130.

The present invention may also be described in terms of a method of assembling and disassembling a toothbrush. FIG. 8 shows a sealed housing 160 containing a head 140. As illustrated in FIGS. 8*a* and 8*e*, sealant strip 166 is peeled from shell 164, and head end 124 of handle 120 is aligned with head 140. As illustrated in FIG. 8*b*, head end 124 is snapped into head 140 and extends through notch 162 in shell 164. In other words, head 140 may be installed on handle 120 without requiring a person to touch head 140. FIG. 8*c* illustrates how housing 160 is removed from the assembled toothbrush, at which point, housing 160 may be discarded. After toothbrush 100 has been used, FIG. 8*d* illustrates how head end 140 may be removed and discarded.

Various elements and/or features of the present invention may be practiced in different combinations. Moreover, various elements and/or features may be implemented in alternative ways without departing from the scope of the present invention. For example, it may be desirable to provide head 140 and some toothpaste in separate portions of an alternative housing; to provide head 140 without any toothpaste; and/or to provide replacement heads 140 in an alternative package without handle 120. Recognizing that this disclosure will enable persons skilled in the art to derive alternative embodiments and/or applications, the scope of the present invention should be limited only to the extent of the following claims.

What is claimed is:

1. A method of brushing teeth, the method comprising the steps of:

providing a handle having a head end and handle end that is sized and configured for grasping by a human hand, wherein the handle is provided with the head end having a trapezoidal cross section;

providing a head having a base that is sized and configured to snap onto the head end of the handle, and bristles that project outward from a first side of the base, wherein the head is provided with toothpaste disposed in the channel;

aligning the head end with an open top, longitudinally extending channel formed on an opposite, second side of the base, said channel defined and bounded by two opposed flexible inwardly convex walls; and pressing and sliding the head end in a direction parallel to the outward projection of the bristles towards the channel;

spreading initially one or both of said flexible inwardly convex walls by the head end of the handle; and snapping the head end into the channel, wherein said flexible inwardly convex walls then move back toward one another and into the operational position;

wherein the handle is provided with rounded concave walls bounding opposite sides of the head end to snugly cooperate with said flexible inwardly convex walls to prevent longitudinal movement in a longitudinal direction along the handle after attachment with the head, and the head is provided with the channel having a trapezoidal profile sized and configured to receive the trapezoidal cross-section of the head end of the handle such that the trapezoidal cross-section and profile cooperate to prevent movement of the head in the direction parallel to the outward projection of the bristles, and wherein the pressing and sliding step squeezes at least some of the toothpaste into spaces defined between the bristles.

2. The method according to claim 1, wherein the head is provided with flexible flaps that discourage toothpaste from moving out of the ends of the channel.

3. The method according to claim 1, wherein the head is provided in a sealed housing that defines a notch when unsealed, and the head is arranged within the housing in such a manner that the notch aligns with the channel to accommodate the moving step without removing the head from the housing or requiring a person to touch the head.

4. The method according to claim 1, wherein the handle is provided without any internal corners formed in the head end.

5. The method according to claim 1, wherein the head is provided in a sealed housing that defines a notch when unsealed, and the head is arranged within the housing in such a manner that the notch aligns with the channel to accommodate the moving step without removing the head from the housing or requiring a person to touch the head.

6. The method according to claim 1, wherein the handle is provided without any internal corners, ridges or crevices formed in the head end.

7. The method according to claim 1, wherein the head is provided in a sealed housing that defines a notch when unsealed, and the head is arranged within the housing in such a manner that the notch aligns with the channel to accommodate the moving step without removing the head from the housing or requiring a person to touch the head.

8. The method according to claim 1, wherein the handle is provided without any internal corners formed in the head end.

9. The method according to claim 1, wherein the handle is provided without any internal corners formed in the head end.

10. The method according to claim 1, wherein the head is provided with toothpaste in the channel, and the moving step squeezes at least some of the toothpaste into spaces defined between the bristles.

11. The method according to claim 10, wherein the head is provided with flexible flaps secured to respective ends of said base and having opposite distal ends that discourage toothpaste from moving out of the ends of the channel.

12. The method according to claim 11, wherein the head is provided in a sealed housing that defines a notch when unsealed, and the head is arranged within the housing in such a manner that the notch aligns with the channel to accommodate the moving step without removing the head from the housing or requiring a person to touch the head.

13. The method according to claim 12, wherein the handle is provided without any internal corners, ridges or crevices formed in the head end.

14. The method according to claim 1, wherein the handle is provided with the head end having a trapezoidal cross-section, and the head is provided with the channel having a trapezoidal profile sized and configured to receive the trapezoidal cross-section.

15. The method according to claim 14, wherein the handle is provided without any internal corners formed in the head end.

16. The method according to claim 1, wherein the head is provided in a sealed housing that defines a notch when unsealed, and the head is arranged within the housing in such a manner that the notch aligns with the channel to accommodate the moving step without removing the head from the housing or requiring a person to touch the head.

* * * * *